United States Patent [19]

Goad

[11] 4,098,335

[45] Jul. 4, 1978

[54] DUAL STRING TUBING HANGER AND RUNNING AND SETTING TOOL THEREFOR

[75] Inventor: Bobby F. Goad, Spring, Tex.

[73] Assignee: Baker International Corp., Orange, Calif.

[21] Appl. No.: 780,603

[22] Filed: Mar. 24, 1977

[51] Int. Cl.[2] ..... E21B 23/06; E21B 33/122

[52] U.S. Cl. ..... 166/120; 166/123; 166/189

[58] Field of Search ..... 166/120–123, 166/189, 314, 315

[56] References Cited

U.S. PATENT DOCUMENTS

| | | | |
|---|---|---|---|
| 3,211,226 | 10/1965 | Myers et al. | 166/120 |
| 3,239,008 | 3/1966 | Leutwyler | 166/189 |
| 3,239,009 | 3/1966 | Leutwyler | 166/120 |
| 3,414,058 | 12/1968 | De Rochemont | 166/189 |
| 3,441,084 | 4/1969 | Fredd | 166/189 |
| 3,841,400 | 10/1974 | Callihan et al. | 166/189 |

*Primary Examiner*—James A. Leppink
*Attorney, Agent, or Firm*—Subkow & Kriegel

[57] ABSTRACT

A hanger for supporting dual tubing strings in a well casing from hanger mandrels which can swivel to facilitate threadedly connecting each mandrel to its associated tubing string. The hanger includes an orienting sleeve for receiving safety shut-off valves, the sleeve being adapted to swivel with respect to the rest of the hanger, making it easier to assemble the hanger onto the running and setting tool used for setting the hanger in the casing. The running and setting tool is releasably secured to the hanger. By imposing fluid pressure on the setting tool, the tubing hanger slips are expanded against the casing. Before the running and setting tool is released from the hanger and retrieved from the well casing, wire line retrievable blanking plugs can be set in the tubing string below the hanger, one plug being inserted in place in one tubing string before the hanger is lowered in the casing, and the other plug lowered through the running tool and hanger to its associated landing nipple in the other tubing string, to maintain the well under control after the running and setting tool is released from the hanger and retrieved at the top of the well bore in which the casing is confined.

38 Claims, 34 Drawing Figures

DUAL STRING TUBING HANGER AND RUNNING AND SETTING TOOL THEREFOR

The present invention relates to tubing hangers carrying a plurality of depending tubing strings and to tools for running and setting such tubing hangers in well casing disposed in well bores.

In U.S. Pat. No. 3,771,603, a tubing hanger is disclosed for supporting a plurality of tubing strings extending downwardly to spaced upper and lower packers that isolate production zones in the well bore. The tubing strings are attached to tubular mandrels threaded at their upper ends into a hanger head and guide structure, to which a running and setting tool for the tubing hanger is also releasable secured by a left-hand connection. With this arrangement, it is difficult to threadedly attach the upper ends of the depending tubing strings to the lower ends of the mandrels, and to assemble the hanger on the running and setting tool.

With the apparatus disclosed in U.S. Pat. No. 3,771,603, one of the dual tubing strings (the long string) is sealingly related to a lower packer set in the well bore between upper and lower producing zones, while the tubing string (the short string) is sealingly related to an upper dual packer to be set in the well bore above the upper producing zone. After the tubing hanger is set in the well casing, the running and setting tool is disconnected from the hanger and is removed from the well bore. Safety valves operatively associated with upper tubing strings are then run in the well bore and properly connected to the hanger and to a Christmas tree, or other control equipment, at the top of the wall bore. The dual packer is then set in the casing, as through the application of fluid pressure to the packer. During the interval between disconnecting the running and setting tool and installing the safety valves and Christmas tree, flow from their producing zones might occur through both tubing strings and through the surrounding annulus in the well casing, which is a potentially hazardous condition.

The present invention provides a method and apparatus in which the running and setting tool permits both the long and short tubular strings depending from the hanger to be closed or plugged before the running and setting tool is disconnected from the hanger after the latter has been set in the casing, thereby preventing fluid flow through the tubing strings following disconnection of the running and setting tool from the tubing hanger and before installation of the safety valves and the Christmas tree. More specifically, one of the tubing strings can have a retrievable blanking plug installed in place below the hanger before the equipment is run in the well bore, a retrievable blanking plug being lowered through the running string, running and setting tool and into the other tubing string after the hanger has been set and the dual packer also set against the casing. Subsequent disconnection of the running and setting tool from the hanger results in the well bore being under control, inasmuch as production cannot flow from the producing zones through the tubing strings, nor can it flow past the set packers into the annulus surrounding the tubing strings.

In addition to the foregoing features, the invention contemplates a dual tubing hanger and running and setting tool combination in which the hanger cannot be set prematurely in the well casing.

A further object of the invention is to provide an improved tubing hanger apparatus, including a running and setting tool, in which the hanger is set hydraulically in the well casing and the running and setting tool is conditioned hydraulically for release from the set tubing hanger, part of the hydraulically operable device also serving to effect hydraulic setting of a lower packer in the well casing below the tubing hanger.

This invention possesses many other advantages, and has other objects which may be made more clearly apparent from a consideration of a form in which it may be embodied. This form is shown in the drawings accompanying and forming part of the present specification. It will now be described in detail, for the purpose of illustrating the general principles of the invention; but it is to be understood that such detailed description is not to be taken in a limiting sense.

Referring to the drawings.

Figure 2:
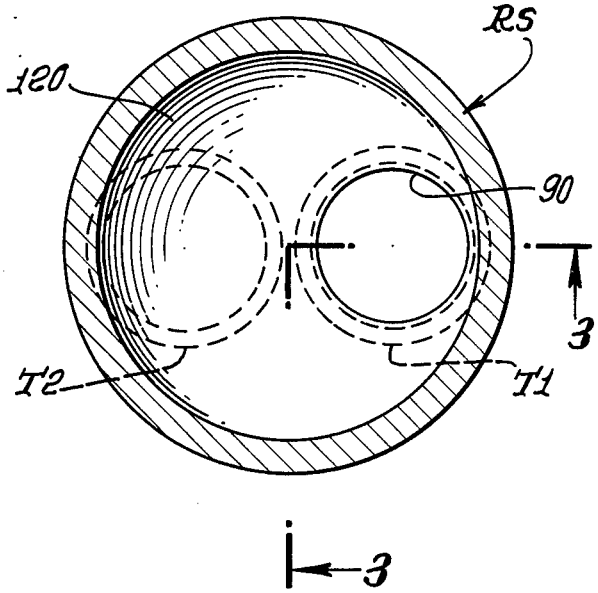
FIG. 2 is an enlarged cross section taken along the line 2—2 on FIG. 1.
Figure 3A:
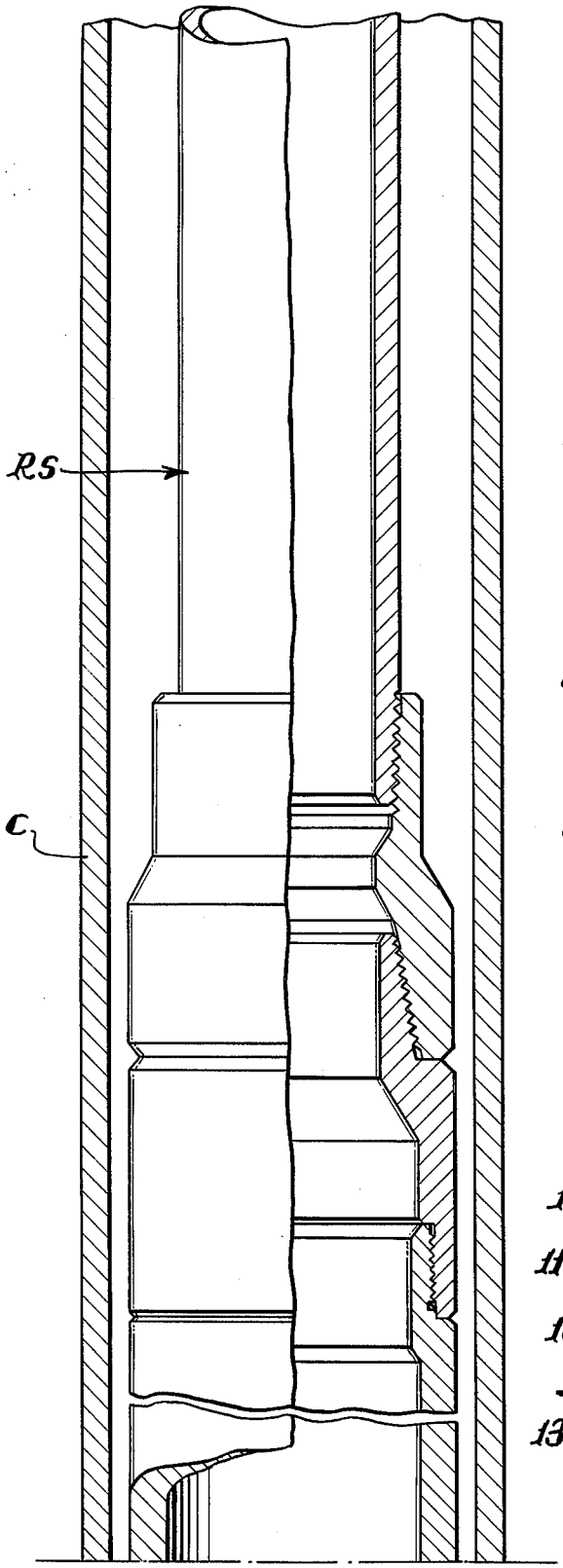
Figure 3B:
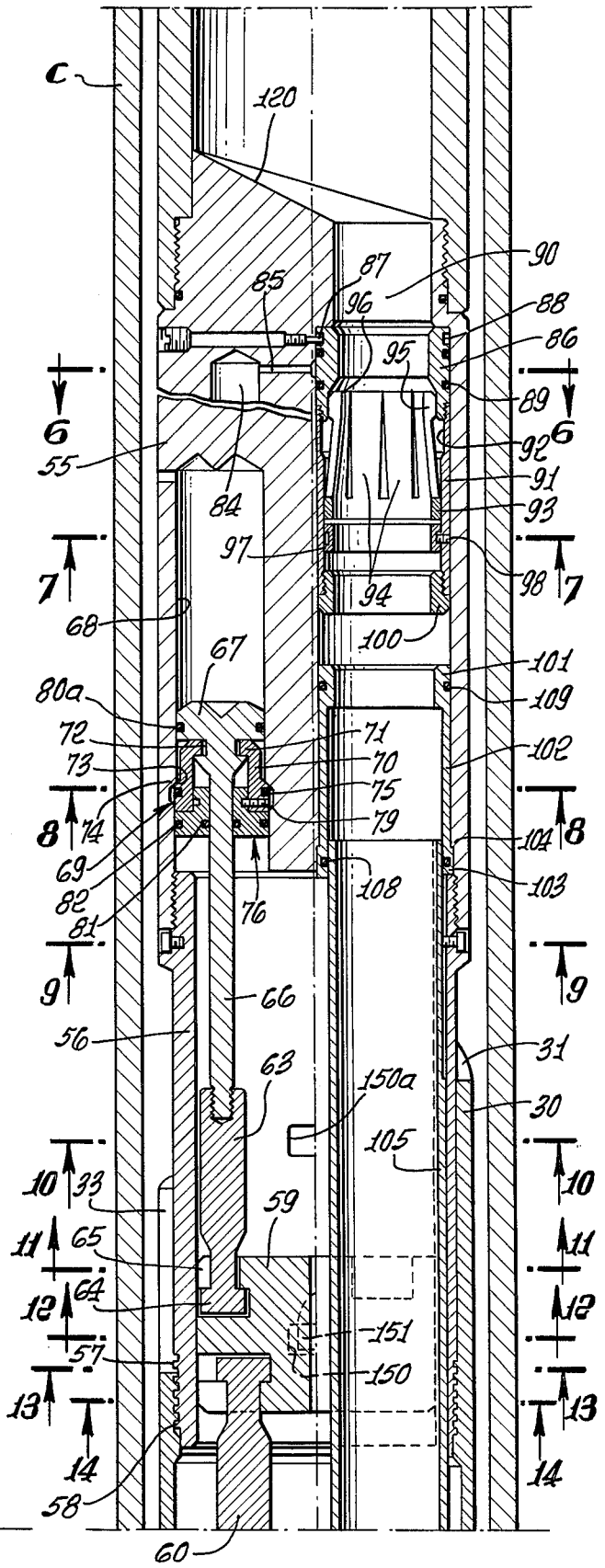
Figure 3C:
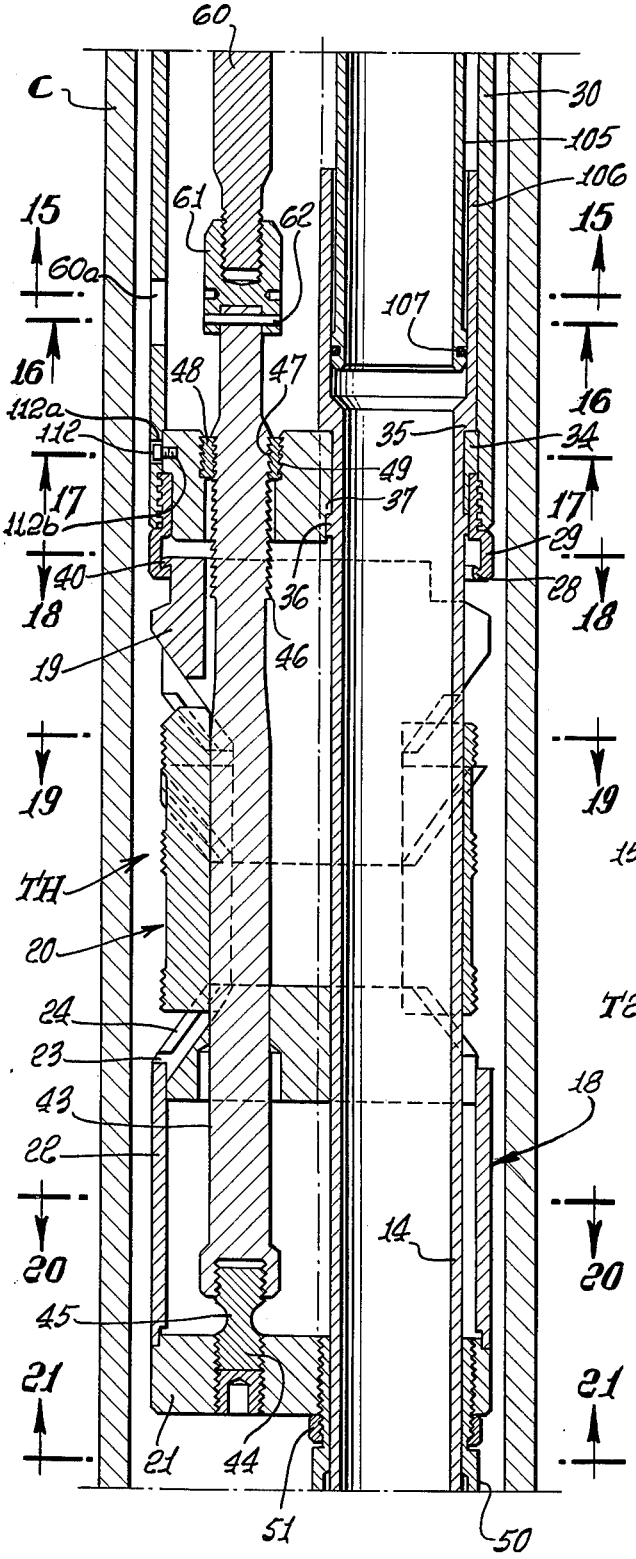
Figure 3D:
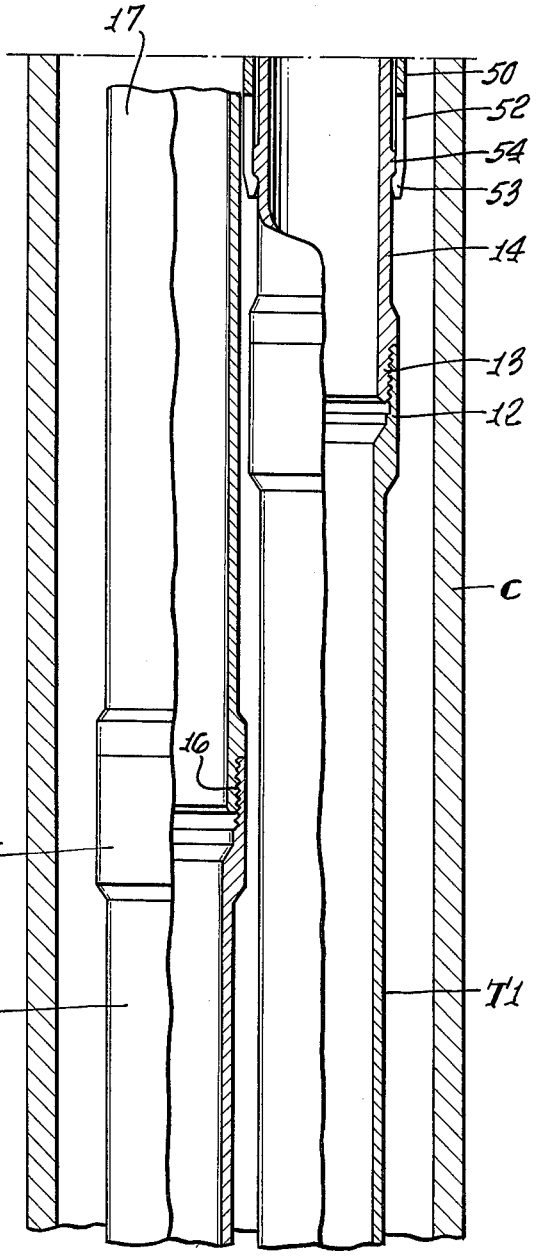
Figure 2A:
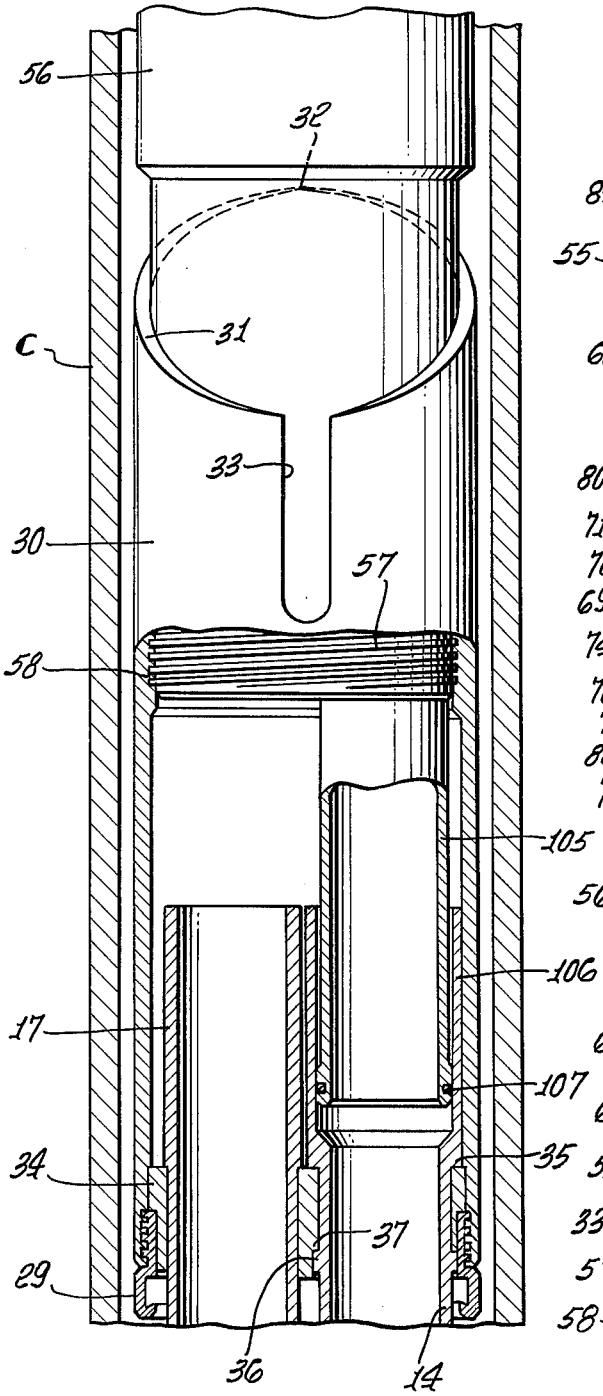

FIGS. 3*a*, 3*b*, 3*c* and 3*d* are longitudinal sections, some parts being shown in side elevation, taken along the line 3—3 on FIG. 2, and illustrating the tubing hanger and running tool secured together prior to setting or anchoring of the hanger against the wall of a surrounding well casing, FIGS. 3*b*, 3*c* and 3*d* being lower continuations of FIGS. 3*a*, 3*b* and 3*c*, respectively.

Figure 4A:
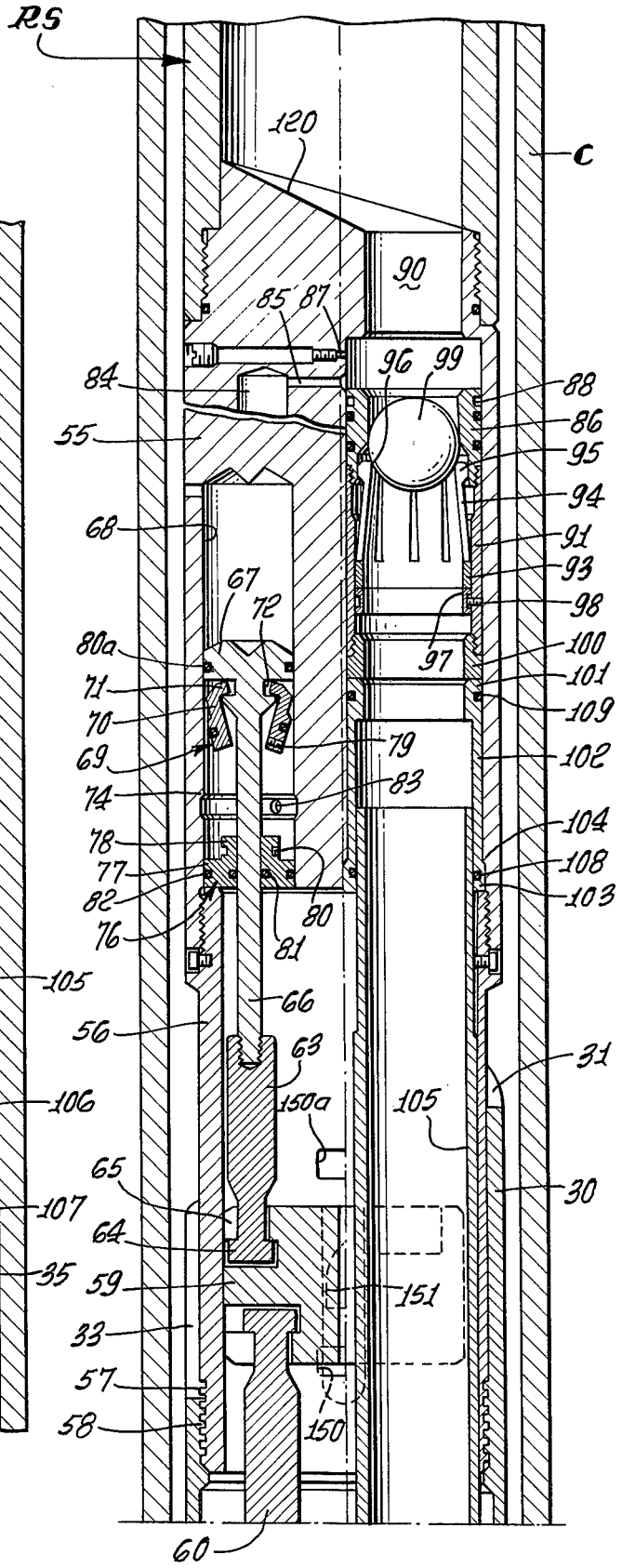
Figure 4B:
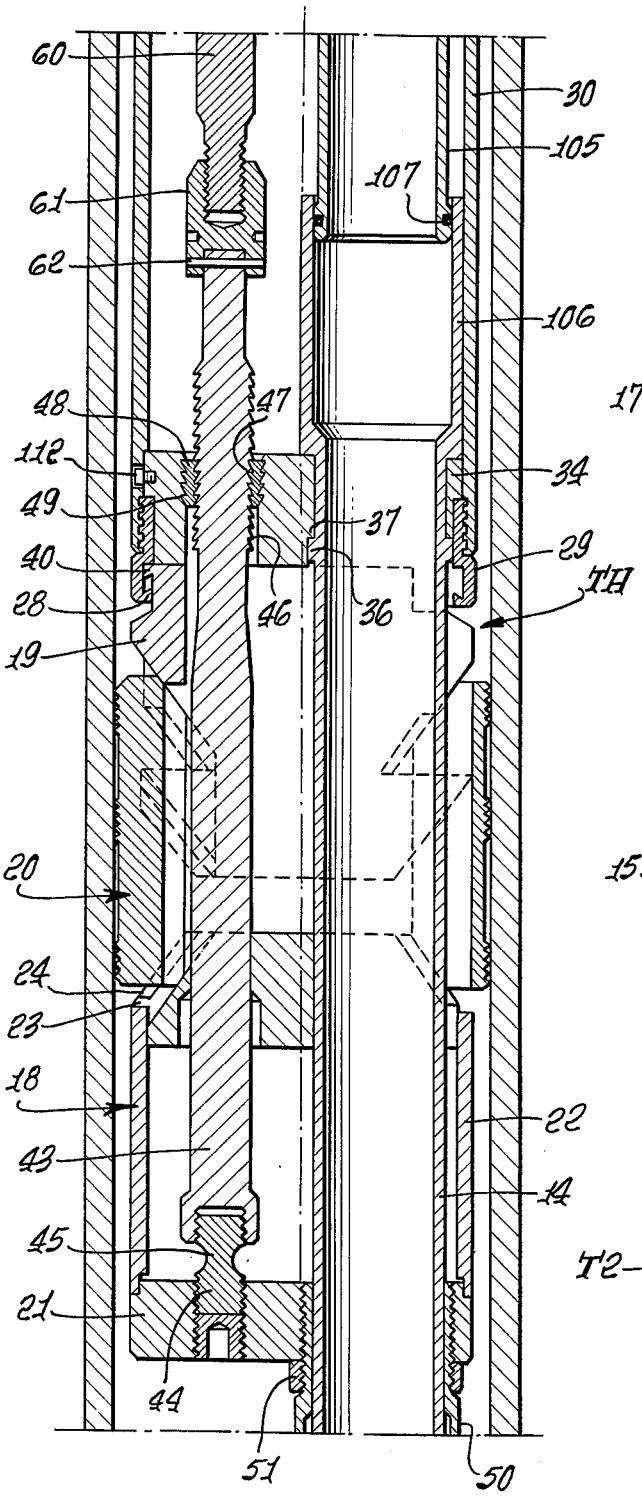
Figure 4C:
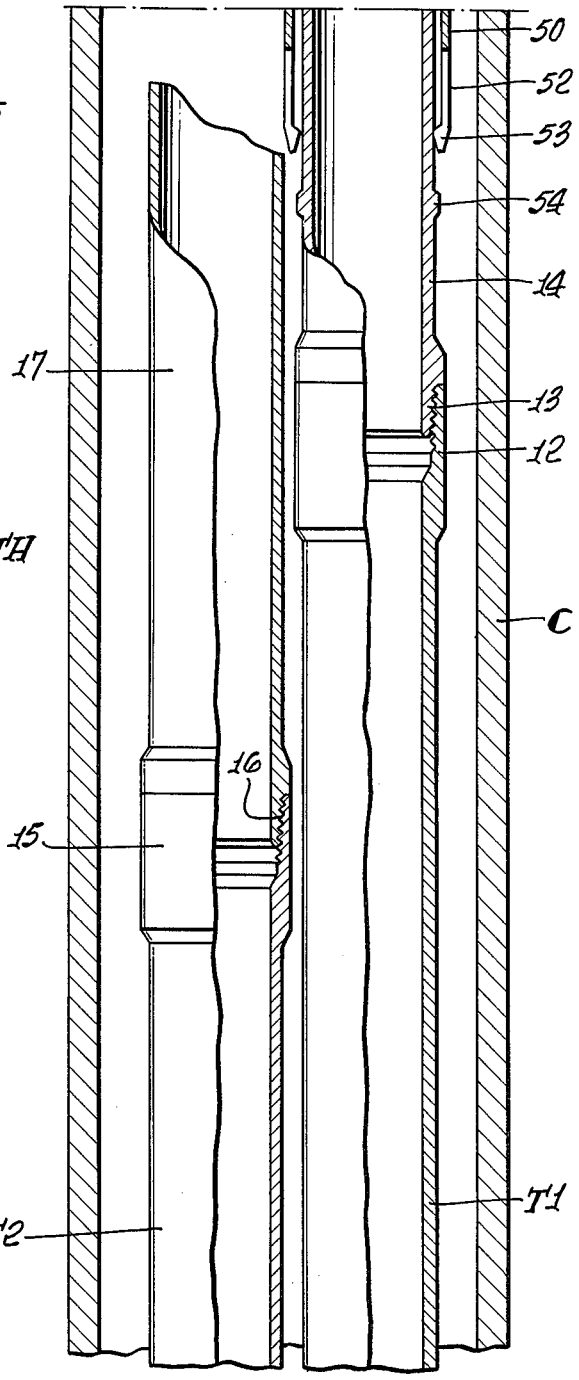
Figure 5A:
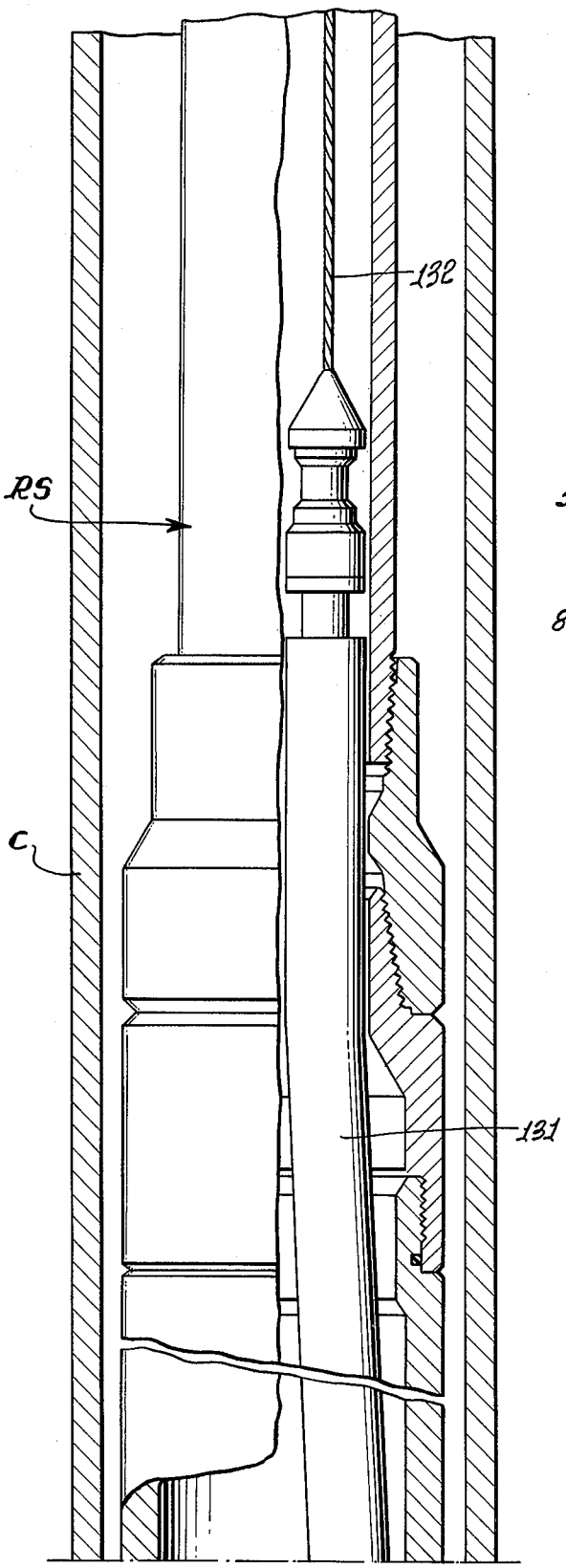
Figure 5B:
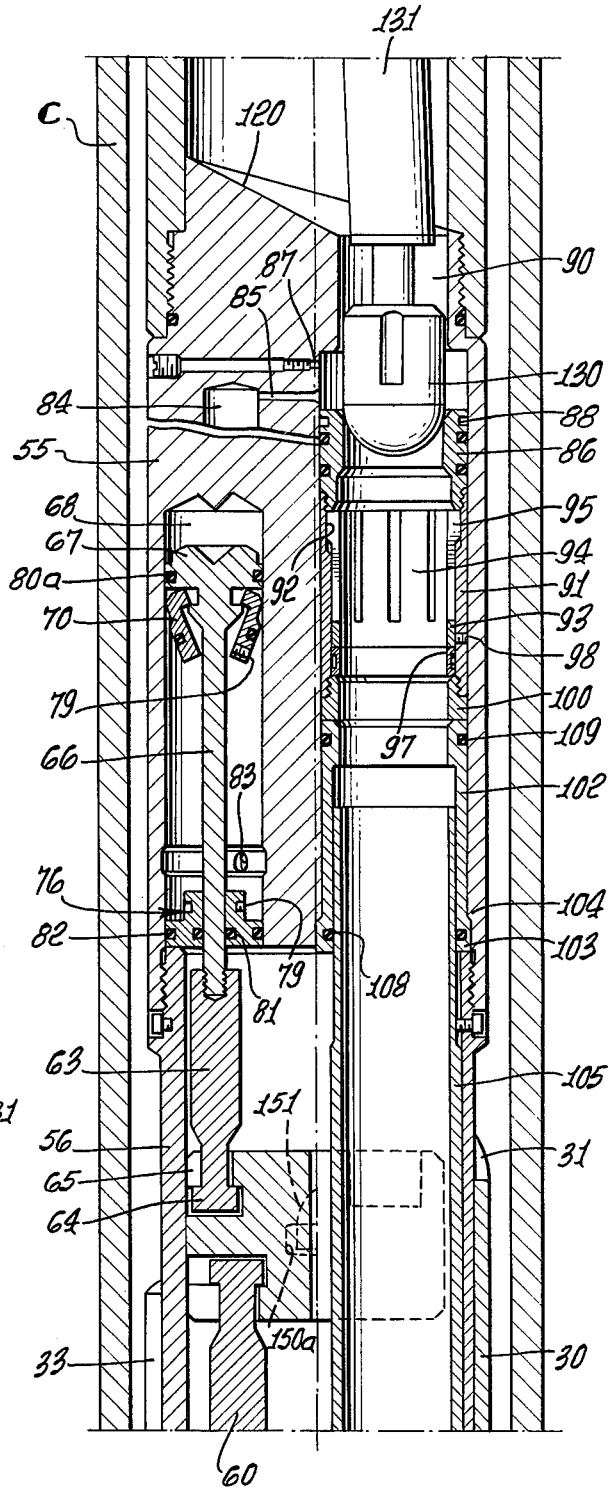
Figure 5C:
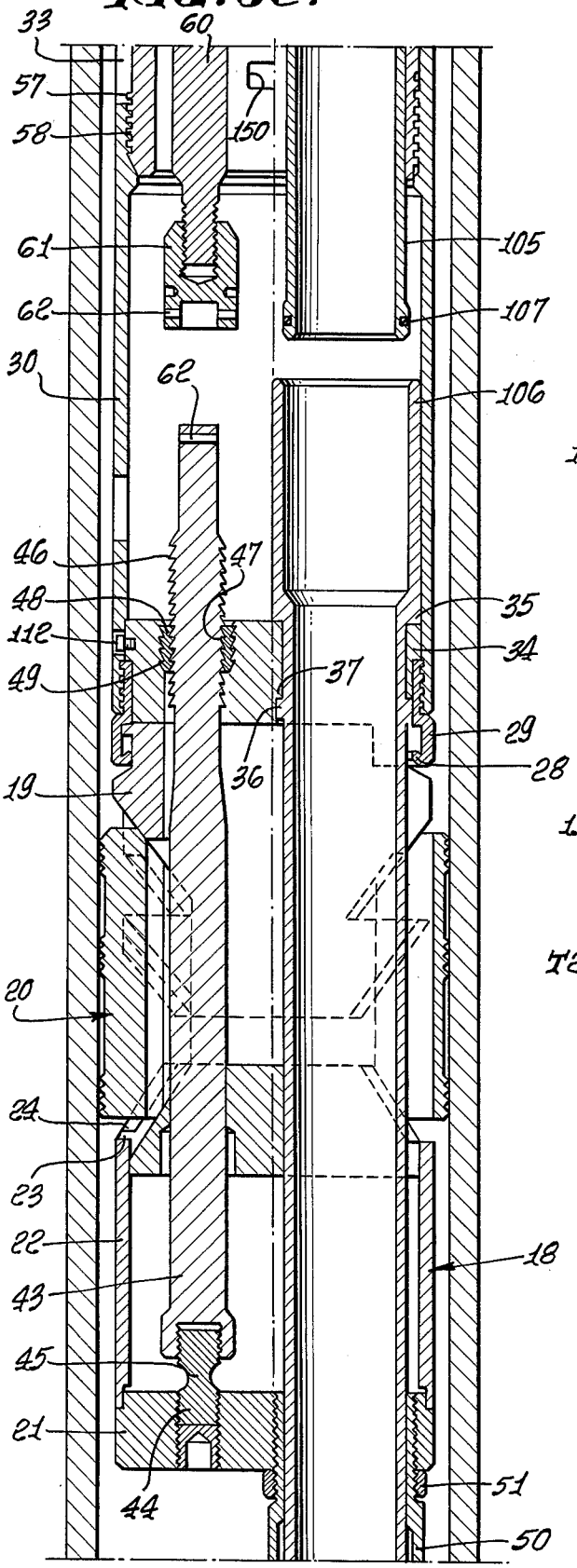
Figure 5D:
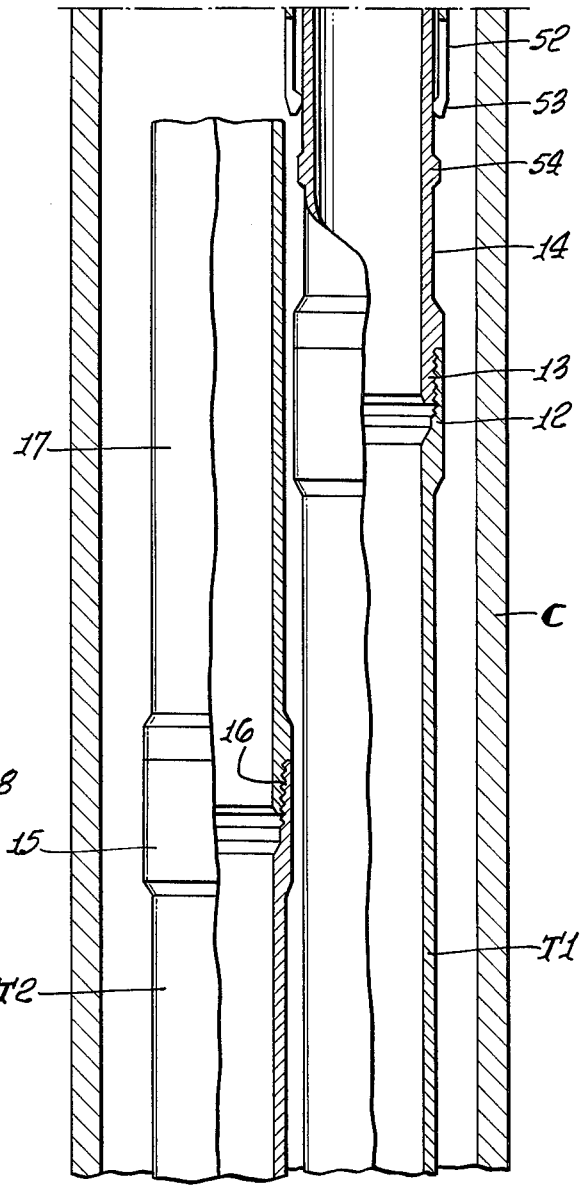
Figure 8:
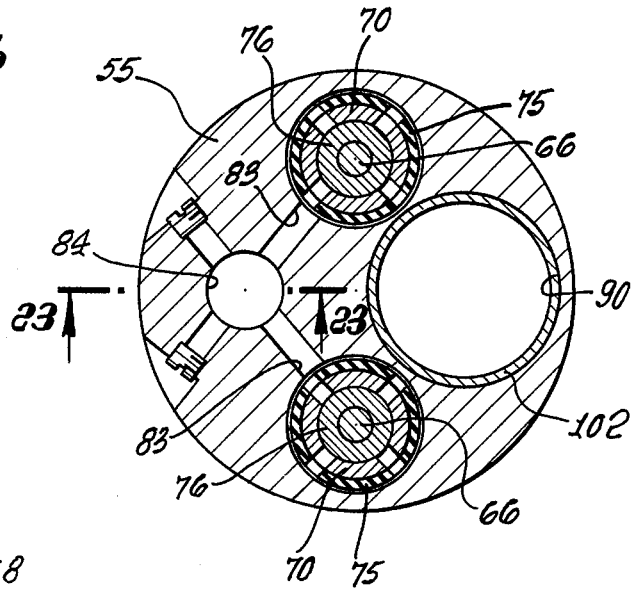
Figure 9:
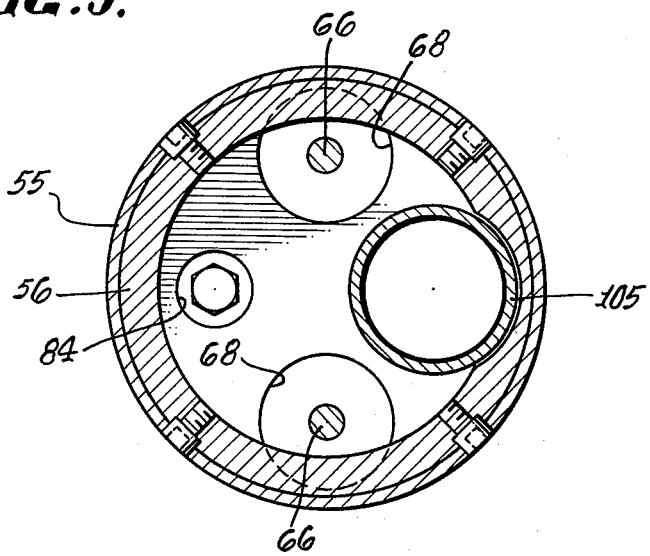
Figure 10:
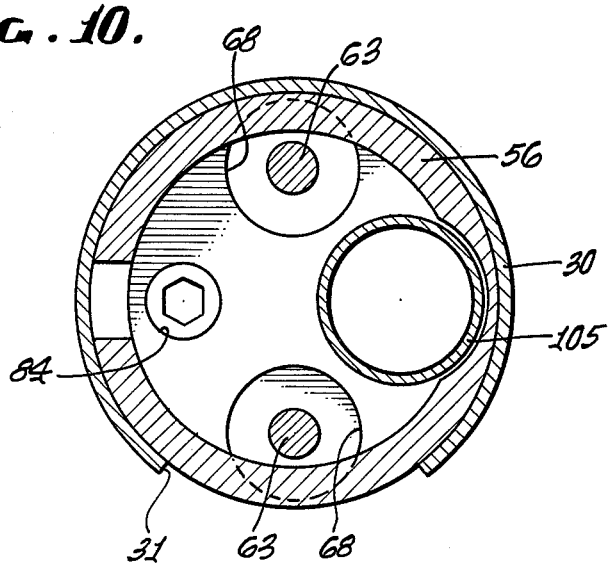
Figure 15:
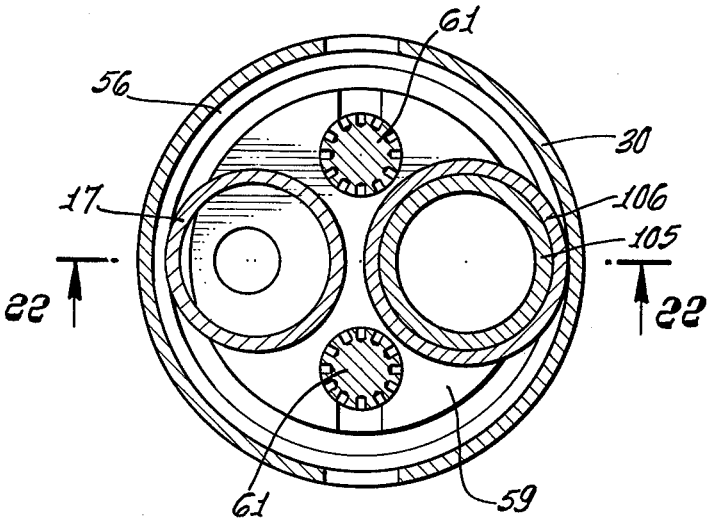
Figure 16:
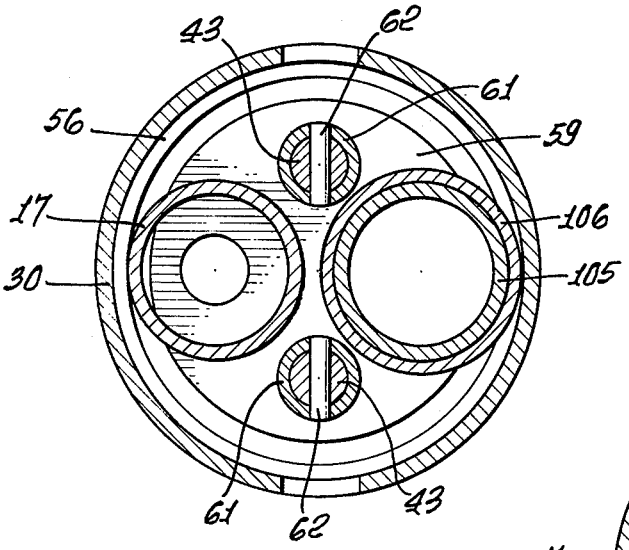
Figure 17:
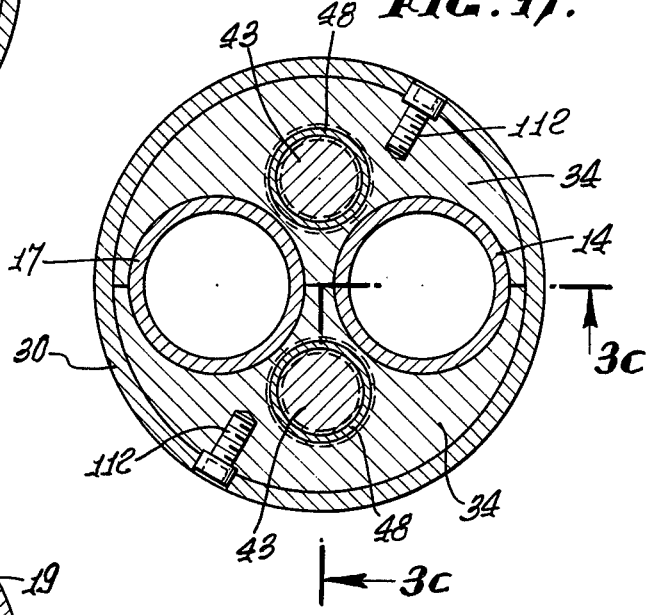
Figure 18:
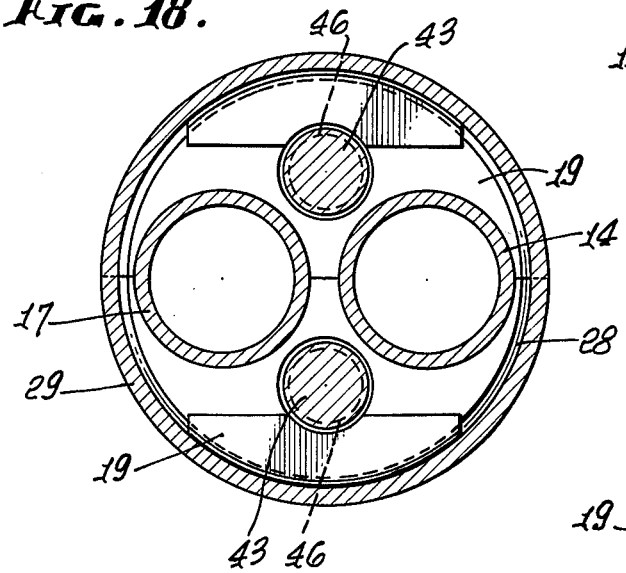
Figure 26:
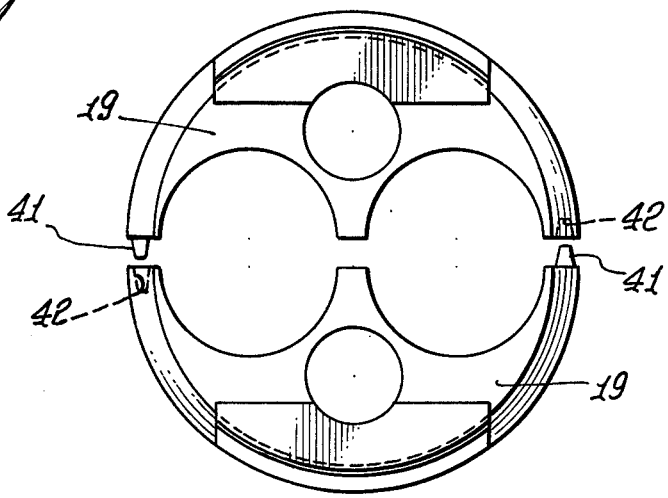
Figure 19:
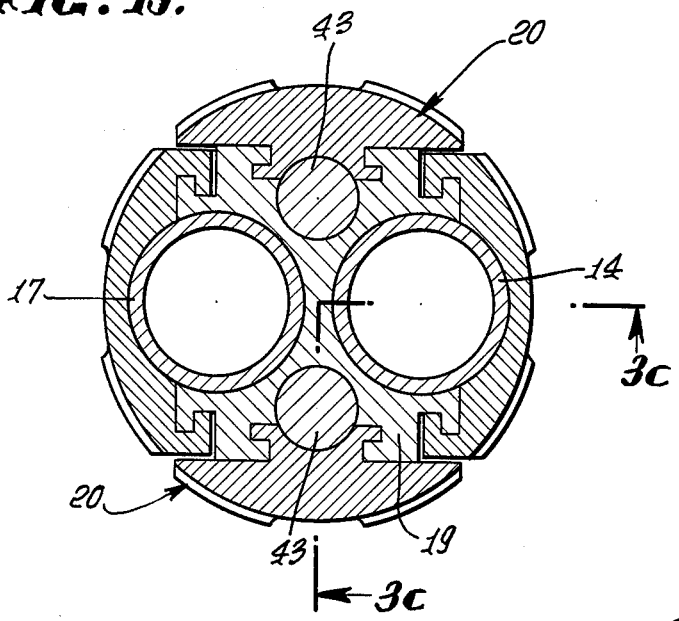
Figure 20:
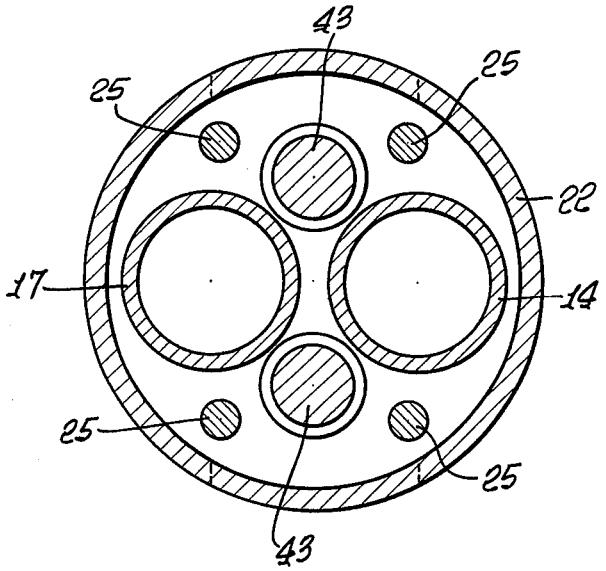
Figure 21:
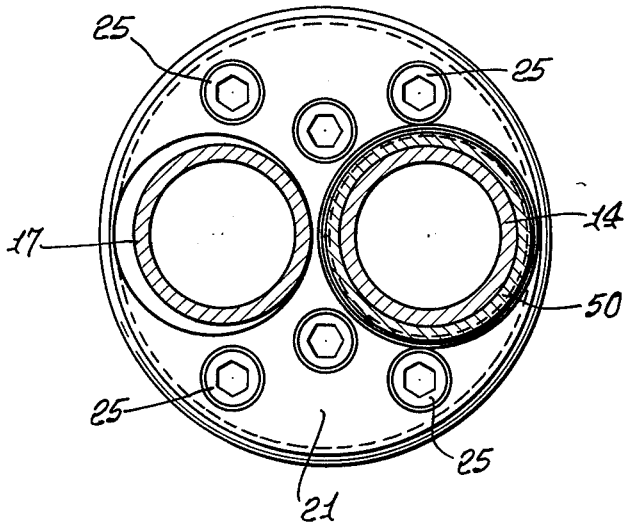
Figure 23:
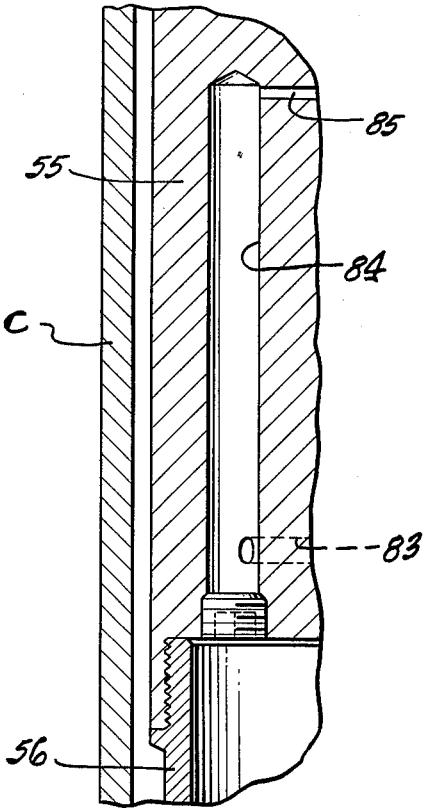
Figure 24:
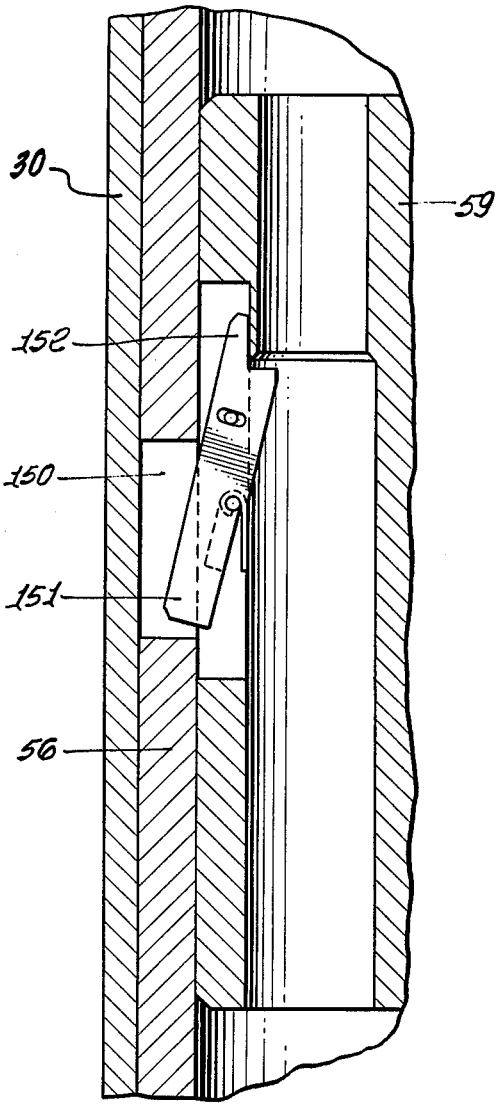
Figure 25:
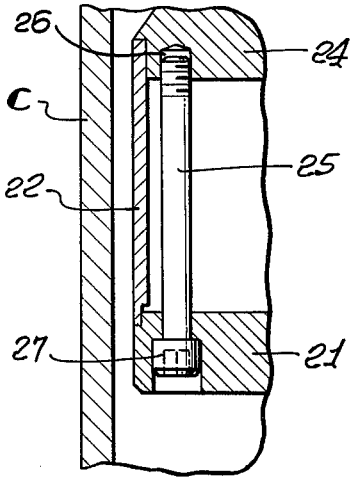

FIGS. 4*a*, 4*b* and 4*c* are views similar to FIGS. 3*a* to 3*d* disclosing the parts as they are related to one another following anchoring of the tubing anchor against the wall of the well casing, FIGS. 4*b* and 4*c* being lower continuations of FIGS. 4*a* and 4*b*, respectively;

FIGS. 5*a*, 5*b*, 5*c* and 5*d* are views corresponding to FIGS. 3 and 4 disclosing the running tool conditioned for release from the tubing hanger preparatory to its being unthreaded from the tubing hanger, FIGS. 5*b*, 5*c* and 5*d* being lower continuations of FIGS. 5*a*, 5*b* and 5*c*, respectively;

FIGS. 6, 7, 8, 9, 10, 11, 12, 13 and 14 are cross-sections taken along the lines 6—6, 7—7, 8—8, 9—9, 10—10, 11—11, 12—12, 13—13 and 14—14, respectively, on FIG. 3*b*;

FIGS. 15, 16, 17, 18, 19, 20 and 21 are cross-sections taken along the lines 15—15, 16—16, 17—17, 18—18, 19—19, 20—20 and 21—21, respectively, on FIG. 3*c*;

FIG. 22 is a longitudinal section, with parts being disclosed in side elevation, taken along the line 22—22 on FIG. 15;

FIG. 23 is a longitudinal section taken along the line 23—23 on FIG. 8;

FIG. 24 is a longitudinal section of a lock for supporting certain parts of the running and setting tool in a particular position during its assembly to the tubing hanger;

FIG. 25 is a longitudinal section, with part shown in side elevation, disclosing the manner of securing the lower portion of the tubing hanger to the lower expander of the tubing hanger; and FIG. 26 is an exploded view of the upper expander structure.

As disclosed diagrammatically in FIG. 1, a well bore W extends downwardly into the earth below the ocean floor F through vertically spaced well fluid producing zones Z1, Z2. A casing C is set in the well bore which has longitudinally spaced perforations P1, P2 to establish communication between the producing zones and the interior of the casing. A lower packer LP is anchored in the casing between the producing zones Z1, Z2 and an upper dual packer UP is set in the casing above the upper producing zone Z2. A first production producing string T1 extends through both packers, opening into the casing below the lower packer LP to establish communication with the lower producing zone Z1. A second production string T2 extends downwardly through the upper packer and terminates above the lower packer so as to establish communication with the upper producing zone Z2. The tubing strings T1, T2 are supported by and extend downwardly from a tubing hanger TH, disclosed in FIG. 1 as being anchored in the well casing. Typically, this tubing hanger will be set in the well casing a short distance below the ocean floor, as, for example, at a depth of about 100 to 500 feet. As a result the tubing strings T1, T2 have lengths which are dependent upon the location of the upper and lower zones surrounding the well bore, ranging from a length of several hundred feet to many thousands of feet.

Figure 1:
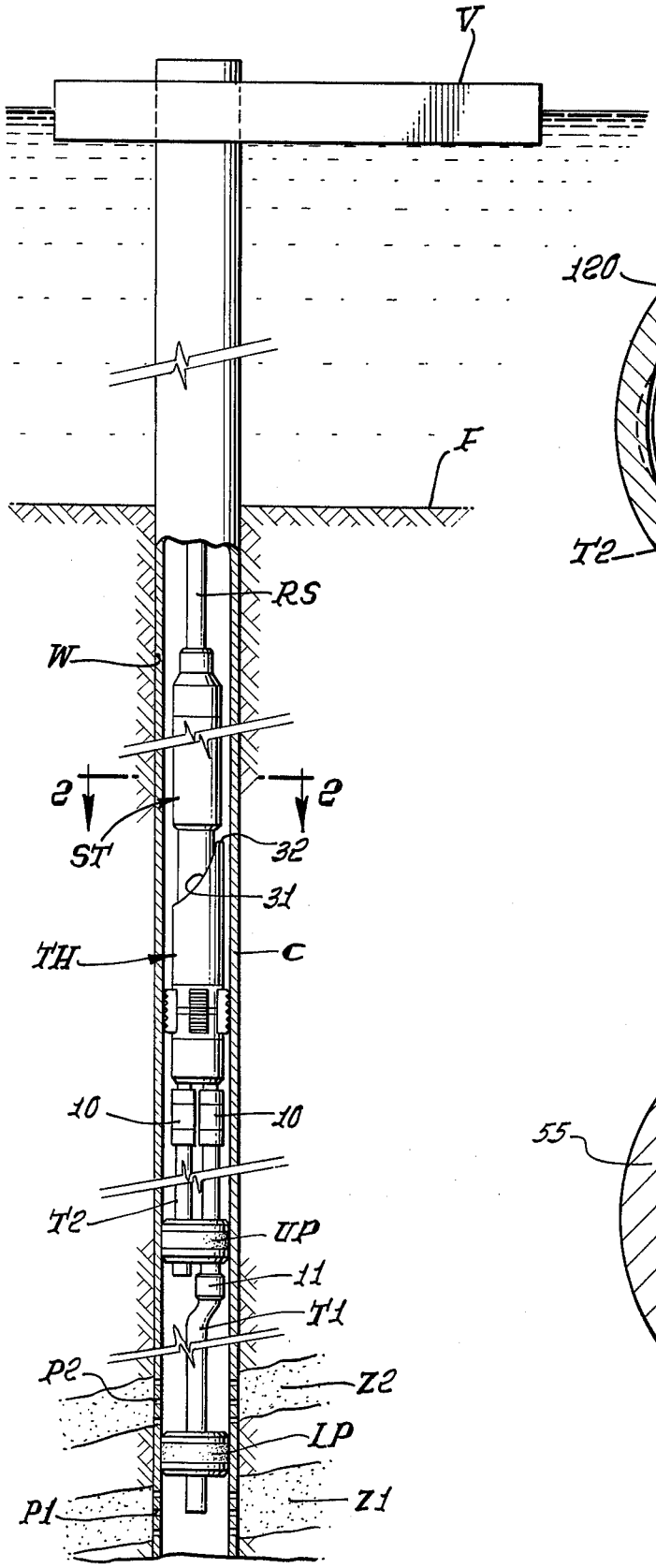
FIG. 1 is a diagrammatic illustration showing a tubing hanger anchored in a well casing and secured to a running and setting tool thereabove, the well casing extending through vertically spaced productive well zones which are isolated from one another by packers and from which well fluids are to flow through a pair of production tubing strings.

As further shown in FIG. 1, a running and setting tool ST is connected to the tubing hanger, the upper portion of which is attached to a running string RS extending upwardly through a body of water overlying the well bore to a suitable floating drilling vessel V, from which the drilling and completion of the well occurs.

The running and setting tool ST and the tubular running string RS of drill pipe, or the like, are used for lowering the tubing hanger TH, with the tubing strings T1, T2 secured thereto, and the upper packer UP attached thereto, into the well casing C to the desired depth. The lower packer LP may or may not be secured to the tubing string T1 extending therethrough during lowering of the apparatus in the well casing, since it may previously have been set in the well casing between the upper and lower sets of perforations P1, P2. In that event, the apparatus with the upper packer UP in the unset condition and the tubing hanger TH in the unset condition are lowered in the well until the tubing string T1 makes a leak-proof connection with the lower packer LP.

Immediately below the tubing hanger TH each tubing may have a landing nipple 10, of a known type, adapted to receive a blanking plug (not shown) of a suitable and known type, in the event the tubing strings are to be closed to prevent production from flowing through the tubing strings from the upper and lower producing zones. These blanking plugs are normally of a wireline retrievable type permitting them to be removed when production is to be permitted to flow from the producing zones. A suitable nipple 11 is also provided in the tubing string a short distance below the upper packer UP to receive a valve element closing the passage through the tubing string and permitting fluid pressure to be applied to the upper packer when the latter is to be set in the well casing.

As used herein, the tubing string T1 communicating with the lower producing zone Z1 will be referred to as the long string; whereas, the other tubing string T2 will be referred to as the short string.

In general, the tubing hanger is disclosed in U.S. Pat. No. 3,771,603, although several modifications are presented in the present application that are not suggested therein and which have important advantages. As disclosed in FIG. 3*d*, the long or first tubing string T1 has an upper box 12 which is threadedly secured to a pin 13 of a long mandrel 14 of the tubing hanger, and which extends upwardly through surrounding parts of the tubing hanger to a location above the anchoring portion of the hanger. Similarly the second or short tubing string T2 has a threaded box 15 threadedly attached to the lower pin 16 of a short tubular mandrel 17 which extends upwardly within the surrounding apparatus of the anchor to a horizontal location substantially corresponding to that of the upper end of the long mandrel.

Both mandrels extend through a lower expander structure 18 (FIG. 3*c*) and an upper expander structure 19, and also along a slip structure 20 which cooperates with the expander structures to be expanded outwardly into anchoring engagement with the well casing C upon relative movement between the expander structures toward one another, and to be retracted from the well casing when the tubing anchor is to be released from the casing and retrieved from the well bore. As disclosed, the lower expander structure 18 includes a lower adapter plate 21 engaged by the lower end of a spacer sleeve 22, the upper end of which engages a downwardly facing shoulder 23 on the lower expander portion 24 of the structure, this latter portion spacer sleeve and adapter plate being secured together by a plurality of cap screws 25 (see FIG. 25) extending through the adapter plate and threaded into a bore 26 in the lower expander 24. Tightening of the screws engages the cap screw heads 27 with the adapter 21 and clamps the spacer sleeve 22 between the adapter and the lower expander.

The upper expander 19 is initially supported from a flange 28 of a dual mandrel ring connector 29 threadedly attached to the lower end of a valve receptacle or orienting guide 30 having a tapered guide surface 31 extending in opposite directions from a peak 32 to a vertically extending slot 33 at the side of the guide. The cam or guide surface 31 is adapted to coact subsequently with dual valve devices (not shown) in order to appropriately orient them with respect to the long mandrel 14 and short mandrel 17, as described in U.S. Pat. No. 3,771,603. The mandrels 14, 17 extend through a dual ring connector 34, the upper end of which engages downwardly facing shoulders 35 on the mandrels, the mandrels being prevented from moving upwardly of the ring connector by mandrel flanges 36 engaging downwardly facing shoulders 37 on the connector 34. The connector acts through the connecting ring 29 to prevent downward movement of the mandrels 14, 17 and of the tubing strings T1, T2 depending therefrom. Relative upward movement of the mandrels with respect to the valve receptacle or orienting guide 30 is prevented by apparatus described hereinbelow. The connector ring 29, dual ring connector 34, and guide 30 constitute a body structure.

Assembly of the dual mandrel ring connector 34 in an appropriate position surrounding the mandrels is effected by making the ring connector in two halves (FIG. 17), which are placed laterally around the mandrels. Assembly of the upper expander 19 occurs through making it into two halves that can be inclined for the purpose of inserting them through the connecting ring flange 28 to locate the upper expander flange 40 above the ring flange, each expander halve having appropriate pins 41 and sockets 42 of one half for engagement with companion pins and sockets in the other halve. At this time, it is to be noted that the upper end of the expander 19 is spaced below the lower end of the mandrel ring connector 34.

The slips 20 are expanded outwardly into anchoring engagement with the well casing by moving the lower expander 18 upwardly toward the upper expander 19, the upward movement of the upper expander being limited by its engagement with the lower end of the ring connector 34. Such upward movement of the lower expander occurs as a result of moving a pair of setting mandrels 43 connected to the adapter plate 21 upwardly. The lower end of each setting mandrel is connected to the adapter plate 21 by a release stud 44 threaded into the adapter plate and also threaded into the lower end of each setting mandrel, this release stud having a weakened section 45 therein which is disrupted in the event the tubing hanger TH is to be released from the well casing C and retrieved from the well bore. The mandrels 43 extend through both upper and lower expanders and through the ring connector 29 and mandrel ring connector 34. They have downwardly facing ratchet teeth 46 that engage upwardly facing ratchet teeth 47 on a split body lock ring or ratchet sleeve 48, the outer surface of which has cam teeth 49 engaging companion cam teeth in the ring adapter 34. The ratchet type of lock described above is well known and is illustrated in U.S. Pat. No. 3,771,603. With this arrangement, the setting mandrels 43 can move upwardly, ratcheting freely through the ring connector 34, the upper expander 19 moving relatively toward the lower expander 18 and effecting expansion of the slips 20 against the well casing. The ratchet teeth 46, 47 co-engage in the event the setting mandrels 43 tend to move downwardly within the ring connector 34, thereby locking the mandrels 43 in the position to which they have moved relatively, and retaining the slip structure 20 anchored against the well casing.

The expanders are normally retained in their initial position by a collet latch 50 surrounding the long mandrel 14 and threadedly connected to the adapter plate 21, unthreading being prevented by a suitable lock ring 51 on the collet engaging the lower end of the adapter plate. The collet includes a plurality of depending latch arms 52 terminating in inwardly directed latch feet 53 which engage the lower end of a latch shoulder or flange 54 on the long mandrel. When the setting mandrels 43 are moved upwardly, as described hereinbelow, the tubular mandrels 14, 17 do not move upwardly with it, the flange 54 engaging the feet 53 and camming them out of the way, permitting the slips 20 to be anchored against the well casing.

Further details of the setting of the slips are unnecessary to an understanding of the present invention, and can be found in U.S. Pat. No. 3,771,603.

The running and setting tool includes a body 55, the upper end of which is threadedly attached to the tubular running string RS extending upwardly to the drilling vessel or platform V. The lower end of this body is threadedly secured to a lower housing 56 which has a lower external left-hand thread 57 meshing with a companion left-hand thread 58 in the valve receptacle or orienting sleeve 30, by means of which the tubing hanger TH is secured to the running tool ST. Located in the lower housing is a setting plate 59 carrying a pair of diametrically opposed lower setting rods 60, each of which is threaded into a shear coupling 61 which, in turn, is secured to a setting mandrel 43 by means of a transverse shear pin 62. A pair of upper setting rods 63 is secured to the setting plate 59 by means of a head 64 on each setting rod fitting within a T-shaped slot 65 in the setting plate, the upper ends of the upper setting rods being threadedly secured to piston rods 66 integral with an upper piston 67 slidable in a longitudinal cylinder 68 within the body 55. Each piston and piston rod cannot move downwardly relative to the body 55 and lower housing 56, since the latter is attached to the orienting guide 30 by the threaded connection 57, 58, and each setting mandrel 43, which is coupled to the upper and lower setting rods 63, 60, cannot move downwardly with respect to the orienting guide since the downward thrust is transmitted through the ratchet teeth 46, 47 and ratchet sleeve 48 to the ring connector 34 secured to the orienting guide.

Initially the pistons 67 cannot move upwardly when fluid pressure is applied to their undersurfaces because of a lock device 69 for each piston. As shown, segmental piston locks 70 have upper inwardly extending lugs 71 received within a peripheral groove 72 in the piston 67 and also outwardly extending lower lugs 73 engaging a downwardly facing shoulder 74 on the body. An O-ring 75, or the like, encircles the piston locks 70 to hold them appropriately attached to the piston during assembly of the apparatus. The segmental piston locks cannot move laterally inwardly because of a lock retainer 76 which surrounds each piston rod 66 and has an outer portion 77 engaging the lower ends of the piston locks and also an upper portion 78 disposed within the piston locks. The lock retainer is secured in its position behind the piston locks by at least one shear screw 79 threaded into the lower portion of a piston lock and received within a groove 80 in the retainer. Accordingly, the piston 67 cannot move upwardly relative to the body because of engagement of the piston locks 70 with the downwardly facing body shoulder 75; whereas, the retainer 76 cannot initially move downwardly because of the shear screw 79 and the upper lugs 71 disposed within the peripheral piston groove 72. Leakage of fluid along the piston is prevented by a suitable seal ring **80*a* on the piston engaging the cylinder wall 68. Leakage of fluid along the lock retainer 76 is prevented by an inner seal ring 81 mounted in the retainer and sealingly engaging the piston rod 66, and by an outer seal ring 82 on a lock retainer engaging the cylinder wall 68** below the body shoulder.

Figure 6:
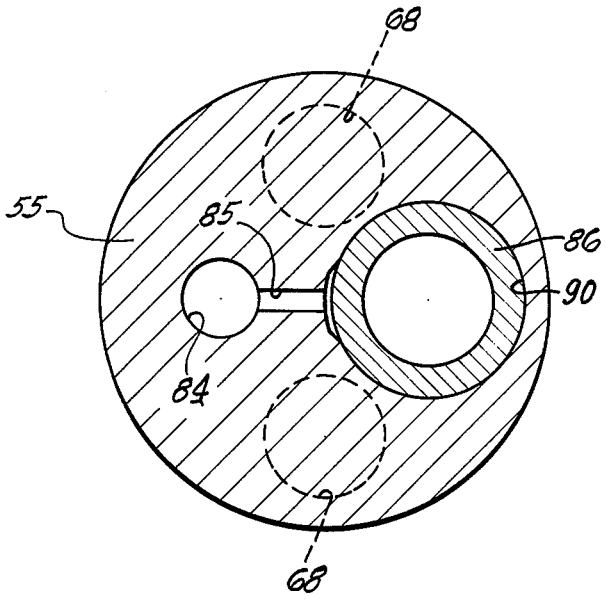
Figure 7:
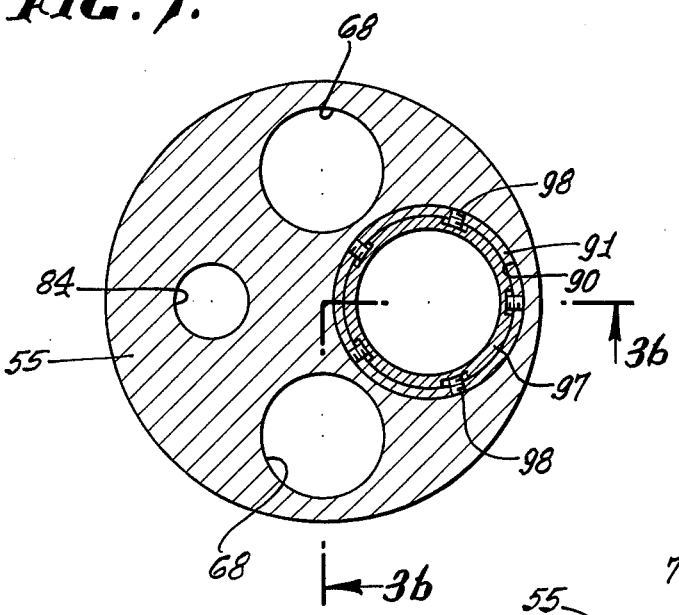

Ports 83 communicate the cylinder spaces between each piston and the lock retainer 76, with a longitudinal fluid passage 84 extending upwardly therefrom in the body 55, the upper end of which communicates with a port 85 that is initially closed by a separation sleeve 86 secured in an upper position, to close the port, by a shear pin 87 extending within a sleeve groove. 88 (FIGS. 6 to 8). Seal rings 89 are carried by the separation sleeve, engaging the wall of a passage 90 extending through the body on opposite sides of the port 85, in order that fluid is initially prevented from flowing from the body passage 90 through the port 85 into the fluid passage 84 and into the cylinder space between each piston and its lock retainer.

The lower end of the separation sleeve 86 is threadedly secured to a collet housing 91, there being an internal circumferential groove 92 defined in the collet housing in conjunction with the lower end of the separation sleeve 86. A collet 93 is disposed within the collet housing and separation sleeve, the lower end of the collet being circumferentially continuous and being slidable along the lower portion of the collet housing. The collet has arms 94 extending upwardly which are deflected inwardly by fingers 95 at the upper ends of the arms engaging the inner wall of the separation sleeve 86, the fingers projecting inwardly partially across the separation sleeve passage and circumferentially abutting one another so as to provide an upper ball seat 96 (FIG. 3*b*). Below the collet is disposed a shear ring 97 releasably secured to the collet housing by one or a plurality of shear screws 98. When a ball 99 (FIG. 4*a*) or corresponding valve member engages the collet fingers 95, the passage 90 through the separation sleeve is obstructed, permitting fluid pressure to be built up which will urge the collet 93 downwardly into engagement with the shear ring 97 and carry the collet housing 91 and the separation sleeve 86 downwardly with it to a position in which a lower stop 100, threadedly secured to the collet housing, engages the upper end 101 of a mandrel sleeve 102 in the body passage which is secured to the body 55 by a lower sleeve flange 103 being clamped between a shoulder 104 on the body and the upper end of the lower housing 56.

The lower portion of the mandrel sleeve 102 encompasses the upper end of a tubular mandrel 105 which extends downwardly and is disposed within the upper receptacle portion 106 of the long mandrel 14. Leakage of fluid between the mandrel 105 and long mandrel receptacle 106 is prevented by a suitable elastomer seal ring 107 on the mandrel engaging the wall of the receptacle, and by a seal ring 108 on the mandrel sleeve 102 sealingly engaging the periphery at the upper portion of the mandrel 105. A seal ring 109 on the upper portion of the mandrel sleeve 102 effects a suitable seal with the wall of the body passage 90.

Figure 11:
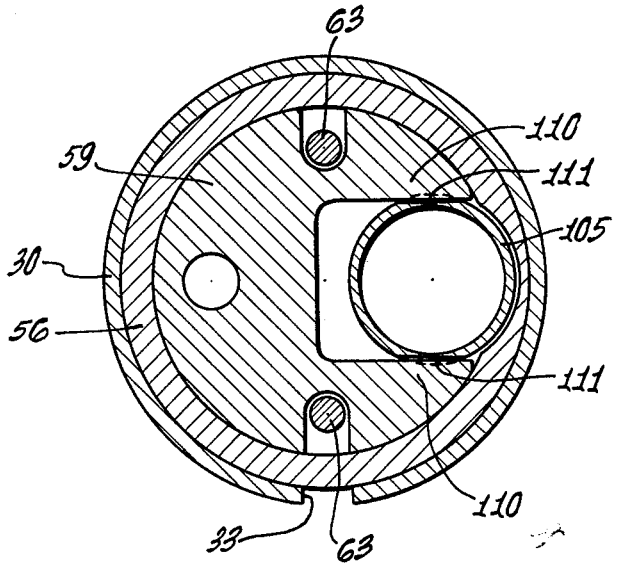
Figure 12:
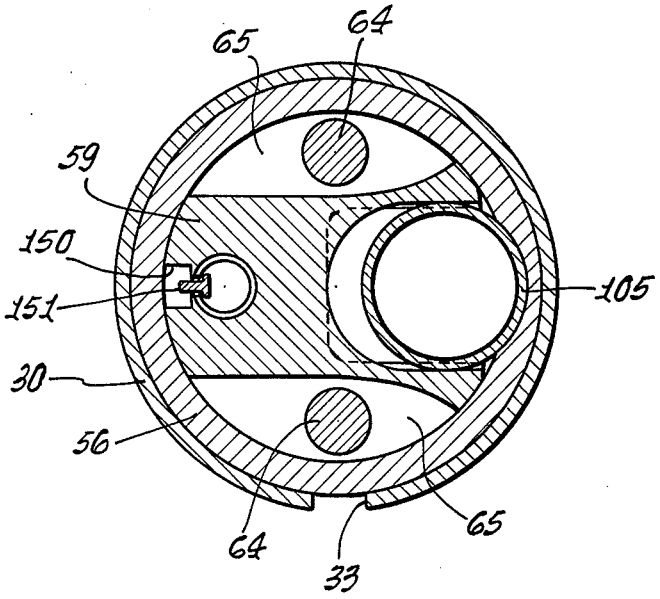
Figure 13:
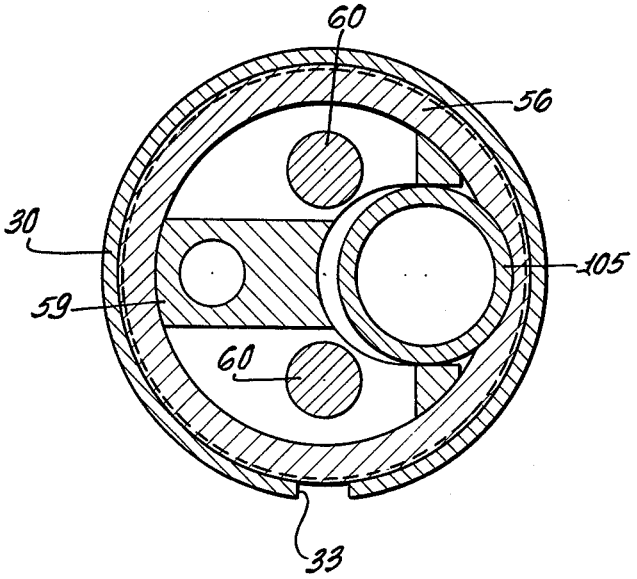
Figure 14:
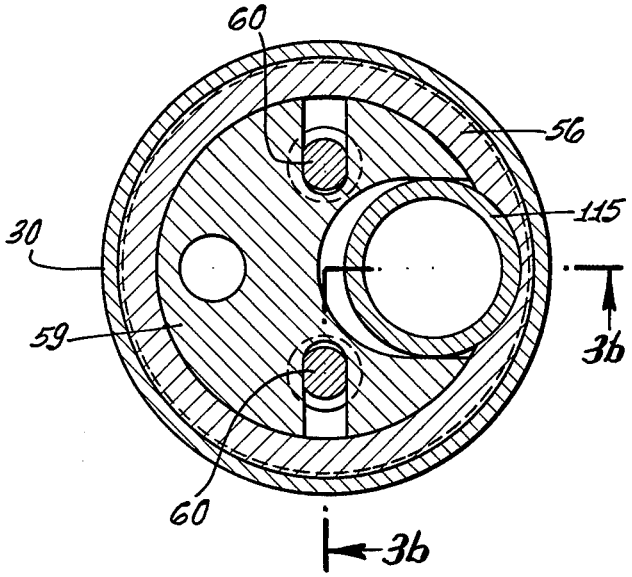

As shown most clearly in FIG. 11, the setting plate 59 is secured to the mandrel 105 by opposed arm portions 110 on the plate disposed within shallow transverse grooves 111 on the periphery of the mandrel, the top and bottom of each groove engaging the plate arms to couple the mandrel to the plate 59 for joint longitudinal movement.

In connecting the running tool to the tubing hanger, the tubing hanger TH initially has its parts occupying the relative position disclosed in FIGS. 3*c* and 3*d*, except that the cap screws 112 are not in place. The running tool ST is lowered into the valve receptacle 30 and the mandrel 105 inserted into the long mandrel receptacle 106, until the thread 57 contacts the thread 58. The receptacle 30 and connector 29 are then rotated as a unit until the threads 57, 58 are substantially fully engaged, whereupon the receptacle 30 is turned sufficiently to align its holes **112*a* with threaded holes 112*b* in the connector 34, to permit the cap screws 112 to be inserted through the hole 112*a* and threaded into the hole 112*b*, which will orient the vertical slot 33 correctly with respect to the mandrels 14, 17. Windows 60*a* are provided in the receptacle 30 to permit access to the shear couplings 61, which are threaded downwardly along the setting rods 60 to stab the coupling over the upper ends of the mandrels 43 and enable the shear pins 62 to be inserted through the couplings 61 and mandrels 43**.

The long and short tubing strings T1, T2, with the dual packer UP appropriately related thereto, are lowered in the well casing C. When an appropriate length has been so lowered, the lower ends of the long and short mandrels 14, 17 are threadedly secured to the long and short tubing strings through the simple expedient of merely turning the long mandrel and the short mandrel, which can readily occur in view of the fact that the long and short mandrels are swivelly mounted within the tubing hanger. Lowering of the tubing strings T1, T2 continues, with the tubing hanger and running tool ST being supported by the running string RS until the setting location of the tubing hanger is reached, at which the long string T1 will have been suitably sealingly related to the lower packer LP, which has been previously set in the casing below the upper and lower sets of perforations P2, P1, and the upper dual packer UP has been appropriately positioned in the casing above the upper perforations P2.

In order to set the tubing hanger, a suitable trip ball 99 is dropped into the running string RS and will engage a tapered guide surface 120 at the upper end of the body 55 which will direct it into the body passage 90 for continued downward movement into engagement with the upper fingers 95 of the collet sleeve. Pressure is then applied to the fluid in the running string sufficient to disrupt the shear pin 87, which permits the separation sleeve 86, collet housing 91 and stop 30 to move downwardly as a unit until the stop engages the upper end 101 of the mandrel sleeve, which will dispose the separation sleeve 86 below the side port 85 and permit fluid to flow from the passage 90 through the port 85 and into the fluid passage 84 that communicates with the side ports 83 opening into the cylinders between the lock retainers 76 and the pistons 67 thereabove. The pressure of the fluid is increased to an extent sufficient to disrupt to shear screw or screws 79 securing the lock retainer to the piston locks 70, whereupon the lock retainers are shifted downwardly into engagement with the upper end of the lower housing 56 to a position spaced from the segmental piston locks, which permits the lower portions of such locks to swing inwardly clear of the restraining shoulder 74, and allows the fluid pressure to move the pistons 67 upwardly within their cylinders 68 (FIG. 4*a*). Such upward movement results in corresponding upward movement of the piston rods 66, upper setting rods 63, setting plate 59 and lower setting rods 60, which pull upwardly on the setting mandrels 43 and move the lower expander 18 toward the upper expander 19, the latter first engaging the lower end of the dual ring connector 34. The setting mandrels 43 continue to move upwardly to shift the lower expander towards the upper expander, effecting outward expansion of the slip structure 20 into anchoring engagement with the well casing C. Since the lower expander slip engaging surfaces taper upwardly and inwardly the tubing hanger is prevented from moving upwardly of the casing; whereas, the downward and inward tapering of the upper expander surfaces will prevent downward movement of the hanger with respect to the casing. The upper expander 19 coacts with the slips 20 to support the weight of the long and short tubing strings T1, T2 hanging from the tubing hanger.

The setting mandrels 43 can ratchet freely through the split ratchet sleeves or lock rings 48, but they cannot move downwardly thereof because of the interengagement between the ratchet teeth 46, 47. In other words, the setting mandrel 43 can move in one direction only, the ratchet teeth locking against one another and holding the slips 20 embedded in the wall of the well casing.

After the tubing hanger has been appropriately secured to the casing, the pressure of the fluid in the passage 90 will be increased to a further extent to overcome the strength of the screws 98 securing the shear ring to the collet housing, the shear ring 97 and collet sleeve 93 moving downwardly to the extent determined by engagement of the shear ring with the stop 100, which will then locate the collet fingers 95 opposite the groove 92, such fingers expanding outwardly into the groove and permitting the trip ball 99 to pass through the sleeve 93 and completely through the long string apparatus and into engagement with a similar collet seat in the nipple 11 in the long string T1 immediately below the dual packet UP. The fluid pressure can then be applied through the long string to the hydraulic mechanism in the dual packer, which is of a known type, such as shown in U.S. Pat. No. 3,414,058, effecting its setting against the wall of the well casing. A further increase in the pressure in the long string will then shift the collet sleeve in the nipple 11 below the dual packer downwardly and permit its fingers to expand, whereupon the trip ball 99 can be pumped out of the long string and drop to the bottom of the well bore.

Prior to running the combination of apparatus in the casing, a retrievable blanking plug (not shown) can be installed in the landing nipple 10 of the tubing string T2. After the tubing hanger and packer are set, a like retrievable blanking plug can be lowered on a wire through the running string RS and the parts 86, 91, 102, 105, and 106 into the tubing string T1 and landed in the other landing nipple 10. Flow of fluid through both tubing strings is thereby prevented.

Fluid from both zones is prevented from flowing upwardly through the casing above the upper packer UP, since it is set in packed-off condition in the casing C. Accordingly, after the running and setting tool RT is released from the hanger TH, the well bore remains under control.

In order to release the running and setting tool ST from the tubing hanger, a blanking plug 130 (FIG. **5*b*) secured to a rod 131 is lowered on a wire line 132 through the running string until the blanking plug comes to rest upon the separation sleeve 86. Fluid pressure is then applied through the fluid in the running string and fluid passages 90, 85, 84, 83 into the cylinders 68, which exerts an upward force on the pistons 67 sufficient to disrupt the shear pins 62 securing the couplings 61 to the setting mandrels 43, the pistons moving upwardly sufficiently to carry the shear couplings above the upper ends of the long and short mandrels 14,17, and removing the mandrel 105, which is supported by the setting plate 59, upwardly and completely out of the receptacle 106 at the top of the long mandrel. The running tool body 55 and lower housing 56 are then free to rotate, right-hand rotation effecting unthreading and upward movement of the lower housing 56 relative to the valve receptacle or orienting guide 30**, permitting the entire tool ST to be elevated from the tubing hanger TH and removed to the drilling vessel or platform V.

Referring particularly to FIGS. **3*b*, 4*a*, 5*b* and 24, it will be noted that the lower housing 56 has longitudinally spaced upper and lower slots 150, 150*a* for receiving a lock member 151 pivotally mounted on the setting plate 59 within a slot therein. The lower end of the member 151 is forced outwardly into the slot 150 or 150*a* by a spring 153 to the extent limited by engagement of an upper nose 152 of the lock member with a companion stop on the setting plate. When the parts are in the position disclosed in FIG. 3*b*, the lock member engages the housing at the lower end of the lower slot 150 to prevent the piston 67 from dropping downwardly during assembly of the running tool with respect to the hanger. When the pistons pull the setting plate 59 upwardly the lock member engages the lower housing above its slot 150, depressing the lock member inwardly from the slot, the lock member remaining in that position until it moves upwardly opposite the upper slot 150*a* (FIG. 5*b*), into which it expands to hold the parts depending from the setting plate 59 in their upper positions, allowing subsequent rotation of the running tool relative to the hanger to unscrew the lower housing from the valve receptacle 30**.

The apparatus is now in condition to receive the safety valves and associated upper tubing strings that will extend from the hanger TH to the platform or drilling vessel V, and which are operatively associated with the surface connections and control lines [all not shown], which are disclosed and described in U.S. Pat. No. 3,771,603.

It is apparent that a tubing hanger has been provided which can be readily secured to the upper ends of the tubing strings T1, T2 depending therefrom, since the hanger mandrels 14, 17 can be readily turned with respect to the depending tubing strings and threaded into the box portions 12, 15 of the latter. In addition, the orienting guide 30 is related to the tubing hanger in such manner as to facilitate the proper relationship of the various parts of the running tool ST with respect to certain portions of the tubing hanger therebelow, visual observation being permitted to insure that the parts can be easily connected to one another, the orienting guide being readily threadedly connected to the housing portion 56 of the running tool. The meeting of the tubing hanger with obstructions and/or restrictions in the well casing cannot effect premature relative movement between the parts. An upward force on the setting mandrels 43 will be transferred through the setting rods 60, 63, 66 and pistons 67 to the piston lock mechanism 69 which is shouldered against the body 55. Any tendency for the long or short mandrels 14, 16, or both, to shift upwardly is resisted by the force being transmitted through the mandrel ring connector 34 and through the split ratchet sleeves 48 to the setting mandrel 43, and through the setting rods 60, 63, 66 and pistons to the piston locks 70. The tubing hanger cannot be set until the tripping ball 99 has been dropped onto the collet seal 96, and the piston locks released.

It is to be noted that a running tool ST has been provided which has a full opening after the tubing hanger TH is set to facilitate setting a packer therebelow, such as the packer UP, and making it possible to run and install a blanking plug (not shown) in the tubing nipple 10 below the hanger, so that when the setting tool is removed, the well is closed in by the set packer UP and blanking plug.

I claim:

1. A setting tool for a tubing hanger to be anchored in a well casing disposed in a well bore, comprising a body structure connectable to a running string and having cylinder means, means on said body structure adapted to releasably connect said body structure to the tubing hanger to enable the setting tool to be disconnected from the tubing hanger and removed from the well bore, piston means shiftable in one direction in said cylinder means to set the hanger in the well casing, releasable lock means in said cylinder means for preventing shifting of said piston means in said one direction, means for conducting fluid under pressure through said body structure to said cylinder means for action on said lock means to release the same and for action on said piston means to shift said piston means in said one direction.

2. A setting tool for a tubing hanger to be anchored in a well casing disposed in a well bore, comprising a body structure connectable to a running string and having cylinder means, piston means shiftable in one direction in said cylinder means to set the hanger in the well casing, releasable lock means in said cylinder means for preventing shifting of said piston means in said one direction, means for conducting fluid under pressure through said body structure to said cylinder means for action on said lock means to release the same and for action on said piston means to shift said piston means in said one direction, said lock means being connected to said piston means and cylinder means, said fluid conducting means opening into said cylinder means between said piston means and lock means so that said fluid under pressure shifts a portion of said lock means in the opposite direction to release said lock means and shifts said piston means in said one direction after release of said lock means.

3. A setting tool as defined in claim 2; said one direction being upwardly, said opposite direction being downwardly.

4. A setting tool for a tubing hanger to be anchored in a well casing disposed in a well bore, comprising a body structure connectable to a running string and having cylinder means, piston means shiftable in one direction in said cylinder means to set the hanger in the well casing, releasable lock means in said cylinder means for preventing shifting of said piston means in said one direction, means for conducting fluid under pressure through said body structure to said cylinder means for action on said lock means to release the same and for action on said piston means to shift said piston means in said one direction, said lock means including segments engaging said piston means and cylinder means and retaining means maintaining said segments engaged with one of said piston means and cylinder means, said fluid conducting means opening into said cylinder means between said piston means and lock means so that said fluid under pressure shifts said retaining means in the opposite direction from said segments to release the same from said one of said piston means and cylinder means and shifts said piston means in said one direction after release of said segments.

5. A setting tool as defined in claim 4; said retaining means maintaining said segments engaged with said cylinder means, said fluid under pressure shifting said retaining means in the opposite direction from said segments to release the same from said piston means.

6. A setting tool as defined in claim 4; said one direction being upwardly in said cylinder means, said opposite direction being downwardly in said cylinder means.

7. A setting tool as defined in claim 5; said one direction being upwardly in said cylinder means, said opposite direction being downwardly in said cylinder means.

8. A setting tool for a tubing hanger to be anchored in a well casing disposed in a well bore, comprising a body structure connectable to a tubular running string and having a longitudinal extending fluid passage adapted to communicate with the running string and longitudinal extending cylinder means to one side of said fluid passage, means on said body structure adapted to releasably connect said body structure to the tubing hanger to enable the setting tool to be disconnected from the tubing hanger and removed from the well bore, piston means shiftable in one direction in said cylinder means to set the hanger in the well casing, releasable lock means in said cylinder means for preventing shifting of said piston means in said one direction, fluid conducting means extending from said fluid passage to said cylinder means, means for closing said fluid conducting means to prevent fluid flow from said fluid passage to said cylinder means, and means for shifting said closing means to open position to permit fluid under pressure to flow from said fluid passage to said cylinder means for action upon said lock means to release the same and for action on said piston means to shift said piston means in said one direction.

9. A setting tool as defined in claim 8; said closing means comprising a sleeve structure in said fluid passage extending across said fluid conducting means, said shifting means being movable down the running string into engagement with said sleeve structure to effect shifting of said sleeve structure in said fluid passage to a position opening said fluid conducting means.

10. A setting tool as defined in claim 9; said sleeve structure including a sleeve extending across said fluid conducting means, a valve seat engageable by said shifting means and expandable from engagement by said shifting means after shifting of said sleeve structure to its position opening said fluid conducting means to permit downward movement of said shifting means through said valve seat and from said fluid passage.

11. A setting tool for a tubing hanger to be anchored in a well casing disposed in a well bore, comprising a body structure connectable to a tubular running string and having a longitudinal extending fluid passage adapted to communicate with the running string and longitudinal extending cylinder means to one side of said fluid passage, piston means shiftable in one direction in said cylinder means to set the hanger in the well casing, releasable lock means in said cylinder means for preventing shifting of said piston means in said one direction, fluid conducting means extending from said fluid passage to said cylinder means, means for closing said fluid conducting means to prevent fluid flow from said fluid passage to said cylinder means, and means for shifting said closing means to open position to permit fluid under pressure to flow from said fluid passage to said cylinder means for action upon said lock means to release the same and for action on said piston means to shift said piston means in said one direction, said lock means being connected to said piston means and cylinder means, said fluid conducting means opening into said cylinder means between said piston means and lock means so that fluid under pressure shifts a portion of said lock means in the opposite direction to release said lock means and shifts said piston means in said one direction after release of said lock means.

12. A setting tool as defined in claim 11; said one direction being upwardly in said cylinder means, said opposite direction being downwardly in said cylinder means.

13. A setting tool for a tubing hanger to be anchored in a well casing disposed in a well bore, comprising a body structure connectable to a tubular running string and having a longitudinal extending fluid passage adapted to communicate with the running string and longitudinal extending cylinder means to one side of said fluid passage, piston means shiftable in one direction in said cylinder means to set the hanger in the well casing, releasable lock means in said cylinder means for preventing shifting of said piston means in said one direction, fluid conducting means extending from said fluid passage to said cylinder means, means for closing said fluid conducting means to prevent fluid flow from said fluid passage to said cylinder means, and means for shifting said closing means to open position to permit fluid under pressure to flow from said fluid passage to said cylinder means for action upon said lock means to release the same and for action on said piston means to shift said piston means in said one direction, said lock means including segments engaging said piston means and cylinder means and retaining means maintaining said segments engaged with one of said piston means and cyliner means, said fluid conducting means opening into said cylinder means between said piston means and lock means so that said fluid under pressure shifts said retaining means in the opposite direction from said segments to release the same from said one of said piston means and cylinder means and shifts said piston means in said one direction after release of said segments.

14. A setting tool as defined in claim 13; said retaining means maintaining said segments engaged with said cylinder means, said segments being released from said cylinder means.

15. A setting tool as defined in claim 13; said one direction being upwardly in said cylinder means, said opposite direction being downwardly in said cylinder means.

16. A setting tool as defined in claim 14; said one direction being upwardly in said cylinder means, said opposite direction being downwardly in said cylinder means.

17. A setting tool as defined in claim 16; said closing means comprising a sleeve structure in said fluid passage extending across said fluid conducting means, said shifting means being movable down the running string into engagement with said sleeve structure to effect shifting of said sleeve structure in said fluid passage to a position opening said fluid conducting means, said sleeve structure including a sleeve extending across said fluid conducting means, a valve seat engageable by said shifting means and expandable from engagement by said shifting means after shifting of said sleeve structure to its position opening said fluid conducting means to permit downward movement of said shifting means through said valve seat and from said fluid passage.

18. Tubing hanger apparatus adapted to be lowered in a well casing disposed in a well bore and to support a plurality of tubing strings depending therefrom, comprising a first body structure, support means carried by said body structure and including initially retracted slip means and expander means for expanding said slip means, a plurality of tubular mandrels mounted in and supported by said body structure, each of said mandrels having connecting means at its lower end adapted for connection to the upper end of an associated tubing string depending therefrom, a second body structure connectable to a tubular running string and releasably connected to said first body structure for disconnection from said first body structure and removal from the well bore, said second body structure having a fluid passage communicating with one of said mandrels and also having cylinder means, piston means in said cylinder means, means connecting said piston means to said support means, said piston means being shiftable in one direction in said cylinder means to move said slip means and expander means with respect to each other to expand said slip means into anchoring engagement with the wall of the well casing to support the tubing hanger apparatus in the well casing, releasable lock means in said cylinder means for preventing shifting of said piston means in said one direction, means for conducting fluid under pressure from said passage to said cylinder means for action on said lock means to release the same and for action on said piston means to shift said piston means in said one direction.

19. Apparatus as defined in claim 18; said lock means being connected to said piston means and cylinder means, said fluid conducting means opening into said cylinder means between said piston means and lock means so that fluid under pressure shifts a portion of said lock means downwardly to release said lock means and said piston means upwardly to set the hanger in the well casing after release of said lock means.

20. Apparatus as defined in claim 18; said lock means including segments engaging said piston means and cylinder means and retaining means maintaining said segments engaged with said cylinder means, said fluid conducting means opening into said cylinder means between said piston means and lock means so that fluid under pressure shifts said retaining means downwardly from said segments to release the same from said cylinder means and shifts said piston means upwardly after release of said segments.

21. Tubing hanger apparatus adapted to be lowered in a well casing disposed in a well bore and to support a plurality of tubing strings depending therefrom, comprising a first body structure, support means carried by said body structure and including initially retracted slip means and expander means for expanding said slip means, a plurality of tubular mandrels mounted in and supported by said body structure, each of said mandrels having connecting means at its lower end adapted for connection to the upper end of an associated tubing string depending therefrom, a second body structure connectable to a tubular running string and releasably connected to said first body structure for disconnection from said first body structure and removal from the well bore, said second body structure having a fluid passage communicating with one of said mandrels and also having cylinder means, piston means in said cylinder means, means connecting said piston means to said support means, said piston means being shiftable in one direction in said cylinder means to move said slip means and expander means with respect to each other to expand said slip means into anchoring engagement with the wall of the well casing to support the tubing hanger apparatus in the well casing, releasable lock means in said cylinder means for preventing shifting of said piston means in said one direction, fluid conducting means extending from said fluid passage to said cylinder means, means for closing said fluid conducting means to prevent fluid flow from said fluid passage to said cylinder means, and means for shifting said closing means to open position to permit fluid under pressure to flow from said fluid passage to said cylinder means for action upon said lock means to release the same and for action on said piston means to shift said piston means in said one direction.

22. Apparatus as defined in claim 21; said closing means comprising a sleeve structure in said fluid passage extending across said fluid conducting means, said shifting means being movable down the running string into engagement with said sleeve structure to effect shifting of said sleeve structure in said fluid passage to a position opening said fluid conducting means.

23. Apparatus as defined in claim 22; said sleeve structure including a sleeve extending across said fluid conducting means, a valve seat engageable by said shifting means and expandable from engagement by said shifting means after shifting of said sleeve structure to its position opening said fluid conducting means to permit downward movement of said shifting means through said valve seat and from said fluid passage.

24. Apparatus as defined in claim 21; said lock means being connected to said piston means and cylinder means, said fluid conducting means opening into said cylinder means between said piston means and lock means so that fluid under pressure shifts a portion of said lock means downwardly to release said lock means and said piston means upwardly to set the hanger in the well casing after release of said lock means.

25. A well production apparatus to be disposed in well casing located in a well bore, comprising tubing hanger apparatus having parallel first and second longitudinal passages and normally retracted means for supporting said hanger apparatus from the inner wall of the well casing, first and second tubing strings depending from and supported by said hanger apparatus, said first and second tubing strings communicating with said first and second passages, respectively, fluid actuated means for expanding said normally retracted means into engagement with the inner wall of the well casing, said hanger apparatus having means for connection with the lower end of a tubular running string, said first passage communicating with the tubular running string, passage means extending from said first passage to said fluid actuated means, first barrier means in said first passage for restricting downward flow of fluid therethrough from the running string to enable fluid pressure to be built up in said passage means for actuating said fluid actuated means, means for removing said barrier means from said first passage to fully open said first passage, said first and second tubing strings including first and second landing nipples, respectively, and a first plug adapted to be lowered through the running string and fully open first passage into said first landing nipple to prevent upward flow of fluid through said first tubing string, said tubing hanger apparatus including a tubing hanger and a setting tool secured to the tubular running string and embodying said fluid actuated means, and means releasably connecting said setting tool to said tubing hanger.

26. Apparatus as defined in claim 25; a second plug in said second landing nipple to prevent upward flow of fluid through said second tubing string.

27. Apparatus as defined in claim 25; said tubing hanger apparatus including a tubing hanger and a setting tool secured to the tubular running string, means releasably connecting said setting tool to said tubing hanger, and second barrier means adapted to be lowered through said running string into said first passage enabling fluid pressure to be built up in said passage means for actuating said fluid actuated means to release said releasable connecting means and allow said setting tool to be elevated from said tubing hanger.

28. Apparatus as defined in claim 27; a second plug in said second landing nipple.

29. Apparatus as defined in claim 25; said first barrier means including a first valve seat in said first passage, and a valve member movable downwardly through the running string into engagement with said seat.

30. Apparatus as defined in claim 25; said first barrier means including a first valve seat in said first passage, and a valve member movable downwardly through the running string into engagement with said seat, said valve seat having an initially contracted portion engaged by said valve member, said valve member and seat being shiftable by fluid pressure in the running string to a position permitting said contracted portion to expand and said valve member to move through said seat and first passage into said first tubing string.

31. Apparatus as defined in claim 25; a hydraulically actuated packer on said tubing strings, said first barrier means including a first valve seat in said first passage, a valve member movable downwardly through the running string into engagement with said seat, a second valve seat in said first tubing string, said first valve seat having an initially contracted portion engaged by said valve member, said valve member and first seat being shiftable by said fluid pressure in the running string into a position permitting said contracted portion to expand and said valve member to move through said first seat, first passage and first tubing string into engagement with said second seat to enable hydraulic setting of said packer in the well casing.

32. Apparatus as defined in claim 31; a second plug in said second landing nipple.

33. A well production apparatus to be disposed in well casing located in a well bore, comprising tubing hanger apparatus having parallel first and second longitudinal passages and normally retracted means for supporting said hanger from the inner wall of the well casing, first and second tubing strings depending from and supported by said hanger apparatus, said first and second tubing strings communicating with said first and second passages, respectively, fluid actuated means for expanding said normally retracted means into engagement with the inner wall of the well casing, said hanger apparatus having means for connection with the lower end of a tubular running string, said first passage communicating with the tubular running string, passage means extending from said first passage to said fluid actuated means, first barrier means in said first passage for restricting downward flow of fluid therethrough from the running string to enable fluid pressure to be built up in said passage means for actuating said fluid actuated means, means for removing said barrier means from said first passage to fully open said first passage, a hydraulically actuated packer on said tubing strings, said first barrier means including a first valve seat in said first passage, a valve member movable downwardly through the running string into engagement with said seat, a second valve seat in said first tubing string, said valve member being movable through said first seat, first passage and first tubing string into engagement with said second seat to enable hydraulic setting of said packer in the well casing.

34. Apparatus as defined in claim 33; said first valve seat having an initially contracted portion engaged by said valve member, said valve member and first seat being shiftable by fluid pressure in the running string to a position permitting said contracted portion to expand and said valve member to move downwardly into engagement with said second seat.

35. Apparatus as defined in claim 34; said first and second tubing strings including first and second landing nipples, respectively, and a first plug adapted to be lowered through the running string and fully open first passage into said first landing nipple to prevent upward flow of fluid through said first tubing string.

36. Apparatus as defined in claim 35; a second plug in said second landing nipple.

37. Apparatus as defined in claim 34; said first and second tubing strings including first and second landing nipples, respectively, and a first plug adapted to be lowered through the running string and fully open first passage into said first landing nipple to prevent upward flow of fluid through said first tubing string.

38. Apparatus as defined in claim 36; a second plug in said second landing nipple.

* * * * *